US009035771B2

(12) United States Patent
Argue et al.

(10) Patent No.: US 9,035,771 B2
(45) Date of Patent: May 19, 2015

(54) THEFT DETECTION SYSTEM

(71) Applicant: Wal-Mart Stores, Inc., Bentonville, AR (US)

(72) Inventors: Stuart Argue, Palo Alto, CA (US); Anthony Emile Marcar, San Francisco, CA (US)

(73) Assignee: WAL-MART STORES, INC., Bentonville, AR (US)

( * ) Notice: Subject to any disclaimer, the term of this patent is extended or adjusted under 35 U.S.C. 154(b) by 189 days.

(21) Appl. No.: 13/756,414

(22) Filed: Jan. 31, 2013

(65) Prior Publication Data

US 2014/0210621 A1 Jul. 31, 2014

(51) Int. Cl.

*G08B 13/14* (2006.01)
*G08B 13/22* (2006.01)
*G08B 13/196* (2006.01)

(52) U.S. Cl.

CPC ..... *G08B 13/22* (2013.01); *G08B 13/19678* (2013.01); *G08B 13/19682* (2013.01)

(58) Field of Classification Search

USPC ..... 340/568.1, 571, 5.53, 572.1, 539.31, 340/10.1, 286.06, 539.13, 540, 541; 455/550.1, 404.1; 348/152, 150

See application file for complete search history.

(56) References Cited

U.S. PATENT DOCUMENTS 3,863,245 A * 1/1975 Swinamer et al. ..... 340/286.06
6,502,749 B1 * 1/2003 Snyder ..... 235/383
7,248,161 B2 7/2007 Spoltore
7,262,690 B2 8/2007 Heaton
7,724,131 B2 5/2010 Chen
8,203,603 B2 6/2012 Harbert
8,489,065 B2 * 7/2013 Green et al. ..... 455/404.1
8,493,210 B2 * 7/2013 Maziak et al. ..... 340/540
8,547,401 B2 10/2013 Mallinson
8,559,030 B2 10/2013 Tsongas
8,633,869 B2 1/2014 Devereaux
8,686,851 B2 4/2014 Davis
8,803,687 B2 * 8/2014 Valiulis et al. ..... 340/571
2007/0076095 A1 4/2007 Tomaszewski
2007/0080806 A1 * 4/2007 Lax et al. ..... 340/572.1
2008/0272910 A1 11/2008 Anderson
2009/0224875 A1 * 9/2009 Rabinowitz et al. ..... 340/5.53
2009/0265106 A1 * 10/2009 Bearman et al. ..... 701/300
2010/0185529 A1 7/2010 Chesnut
2011/0057797 A1 * 3/2011 Parker et al. ..... 340/568.1
2011/0149078 A1 * 6/2011 Fan et al. ..... 348/152

(Continued)

FOREIGN PATENT DOCUMENTS

EP 2645667 A1 10/2013
WO WO2004066590 A2 8/2004

(Continued)

*Primary Examiner* — Hoi Lau

(74) *Attorney, Agent, or Firm* — Howard & Howard Attorneys PLLC

(57) ABSTRACT

A computer-implemented method is disclosed herein. The method includes the step of receiving, at a processing device of a monitoring server, a theft detection signal from a first augmented reality device worn by a first employee of a retail store. The method also includes the step of linking, with the processing device, the first augmented reality device in communication with an electronic computing device operated by a second employee in response to said step of receiving the theft detection signal. The second employee can assist the first employee in assessing whether a theft is occurring.

20 Claims, 7 Drawing Sheets

(56) References Cited

U.S. PATENT DOCUMENTS

| | | | | |
|---|---|---|---|---|
| 2012/0062380 | A1* | 3/2012 | Bird et al. | 340/539.31 |
| 2012/0233032 | A1 | 9/2012 | Calman | |
| 2012/0282974 | A1* | 11/2012 | Green et al. | 455/550.1 |
| 2013/0031202 | A1 | 1/2013 | Mick | |
| 2013/0035581 | A1 | 2/2013 | Vesto | |
| 2013/0050496 | A1 | 2/2013 | Jeong | |
| 2013/0136242 | A1* | 5/2013 | Ross et al. | 379/85 |
| 2013/0142494 | A1* | 6/2013 | Valiulis et al. | 386/225 |
| 2013/0187952 | A1 | 7/2013 | Berkovich | |
| 2013/0227681 | A1 | 8/2013 | Hong | |
| 2013/0249942 | A1 | 9/2013 | Green | |
| 2013/0278631 | A1 | 10/2013 | Border | |
| 2014/0096220 | A1 | 4/2014 | Da Cruz Pinto | |
| 2014/0100997 | A1 | 4/2014 | Mayerle | |
| 2014/0118140 | A1* | 5/2014 | Amis | 340/539.13 |
| 2014/0167917 | A2* | 6/2014 | Wallace et al. | 340/10.1 |
| 2014/0211017 | A1* | 7/2014 | Argue et al. | 348/150 |

FOREIGN PATENT DOCUMENTS

| | | | |
|---|---|---|---|
| WO | WO2012162799 | A1 | 12/2012 |
| WO | WO2014063724 | A1 | 5/2014 |

* cited by examiner

THEFT DETECTION SYSTEM

BACKGROUND INFORMATION

1. Field of the Disclosure

The present invention relates generally to systems and methods for deterring theft in a retail store. In particular, examples of the present invention are related to recording evidence of theft using an augmented reality device.

2. Background

Some retail stores extend across tens of thousands of feet and offer thousands of items for sale. Many customers visit such retail stores when shopping for a diverse set of items such as groceries, office supplies, and household wares. Typically, these stores can have dozens of aisles and/or departments. Accordingly, monitoring every portion of the store to prevent theft can be a challenging task. Merchants who sell products including groceries, office supplies, and household wares employ personnel and implement systems and policies to deal with the problem of theft. Eyewitness accounts of theft provide strong evidence used to convict thieves yet in many cases the eyewitness testimony cannot be trusted. It is the policy of many merchants that only security guards are trusted eyewitnesses to theft.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
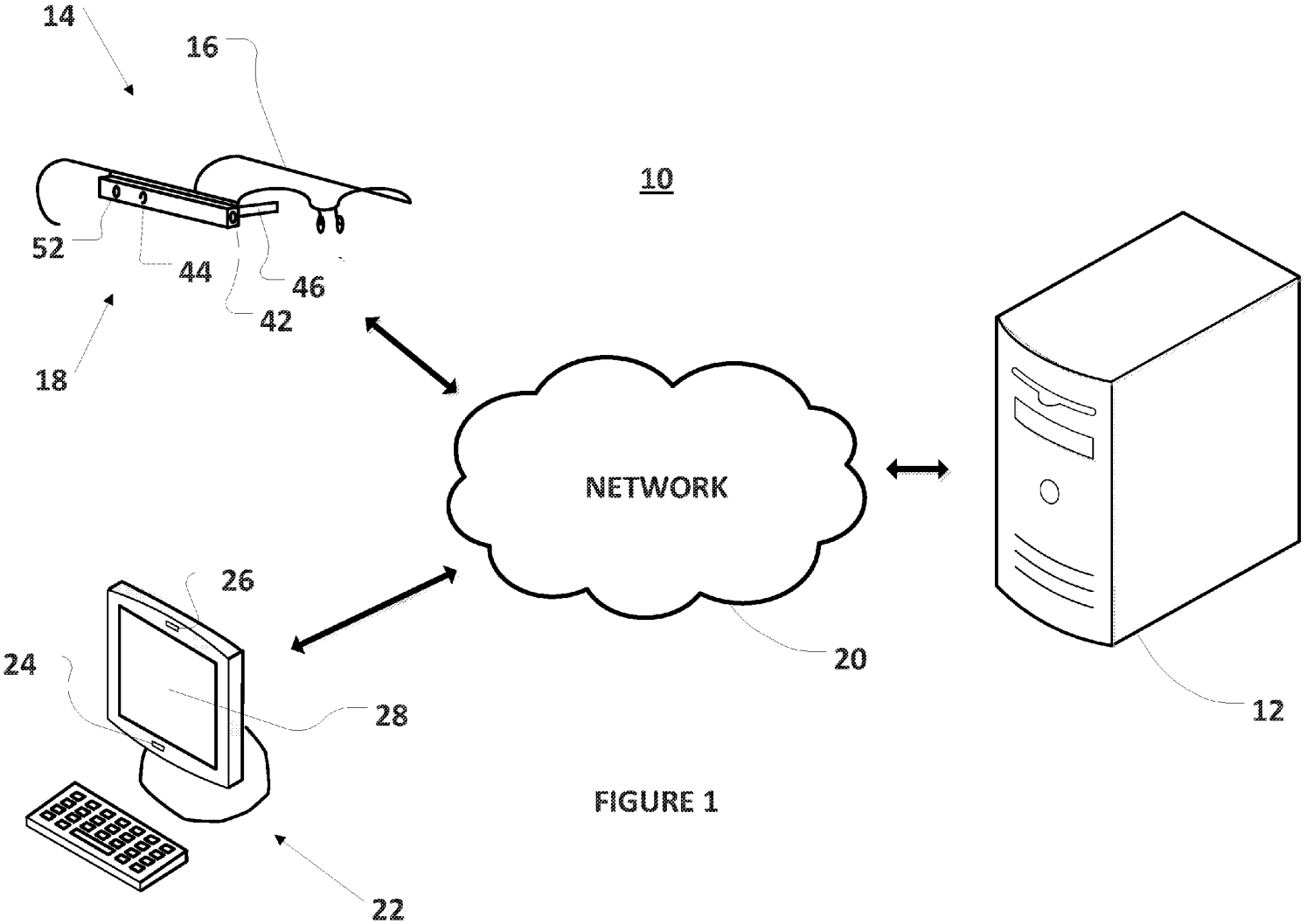
FIG. 1 is an example schematic illustrating a system in accordance with some embodiments of the present disclosure.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present disclosure. It will be apparent, however, to one having ordinary skill in the art that the specific detail need not be employed to practice the present invention. In other instances, well-known materials or methods have not been described in detail in order to avoid obscuring the present disclosure.

Reference throughout this specification to "one embodiment", "an embodiment", "one example" or "an example" means that a particular feature, structure or characteristic described in connection with the embodiment or example is included in at least one embodiment of the present disclosure. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present disclosure may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible medium of expression having computer-usable program code embodied in the medium.

It is desirable to have evidence of theft when prosecuting a suspected thief. A video of a theft occurring can be used as evidence. Eye witness testimony can be used as evidence. However, many merchants consider only security guards as reliable eyewitnesses.

Embodiments of the present disclosure can help merchants prevent theft and prosecute perpetrators recording evidence of theft. Some embodiments of the present disclosure can also allow a security guard to witness a theft in real-time. For example, a system according to an embodiment of the disclosure can include a monitoring server receiving signals from an augmented reality device such as a head mountable unit worn by a store employee as he goes about his duties in the retail store. When the employee witnesses suspicious customer behavior, the augmented reality device worn by the employee can transmit a theft alert signal. The monitoring server can receive and process the theft alert signal. In response to the theft alert signal, the monitoring server can link the augmented reality device with an electronic computing device operated by a second employee, such as a security guard. The security guard can be located at the retail store or at a remote location.

FIG. 1 is a schematic illustrating a theft detection system 10 according to some embodiments of the present disclosure. The theft detection system 10 can execute a computer-implemented method that includes the step of receiving, with a monitoring server 12, a theft alert signal from an augmented reality device worn by a first employee in a retail store. The theft alert can be conveyed in an audio signal, a video signal or can contain both audio and video data.

The theft alert signal can be communicated to the monitoring server 12 with an augmented reality device such as a head mountable unit 14. The head mountable unit 14 can be worn by an employee while the employee is performing his duties within the retail store. In the illustrated embodiment of FIG.

1, the exemplary head mountable unit 14 includes a frame 16 and a communications unit 18 supported on the frame 16.

Signals transmitted by the head mountable unit 14 and received by the monitoring server 12, and vice-versa, can be communicated over a network 20. As used herein, the term "network" can include, but is not limited to, a Local Area Network (LAN), a Metropolitan Area Network (MAN), a Wide Area Network (WAN), the Internet, or combinations thereof. Embodiments of the present disclosure can be practiced with a wireless network, a hard-wired network, or any combination thereof.

The monitoring server 12 can determine that the theft alert signal contains data indicative of an alert or warning that a theft may be occurring. The first employee can reach this conclusion while observing the behavior of a person in the retail store and use the head mountable unit 14 to convey this suspicion/conclusion to the security guard. For example, the signal can be an audio signal containing the first employee's voice stating a theft is occurring. In response to receiving the theft alert signal, the monitoring server 12 can link the head mountable unit 14 worn by the first employee with an electronic computing device 22 that is physically remote from the head mountable unit 14. The monitoring server 12 can link the head mountable unit 14 and the electronic computing device 22 to permit communication between the first employee and a security guard operating the electronic computing device 22. In some embodiments of the present disclosure, the electronic computing device 22 can be located in the same retail store with the first employee. In some embodiments of the present disclosure, the electronic computing device 22 can be remote from the retail store occupied by the first employee.

The operator of the electronic computing device 22 is a security guard operable to assist the first employee in gathering evidence of a theft. For example, the first employee can verbally state the circumstance giving rise to the suspicion that a theft is occurring. The statements of the first employee can be captured by a microphone 44 of the head mountable unit 14 and transmitted by the head mountable unit 14 to the monitoring server 12. The initial signal from the first employee can be denoted as a theft alert signal. Subsequent signals originating from the first employee during the interaction with the security guard can be denoted as monitoring communication signals, as the first employee is monitoring the suspected perpetrator's behavior in the retail store.

The monitoring server 12 can receive the theft alert signal and one or more subsequent monitoring communication signals from the first employee. The monitoring server 12 can transmit the theft alert and monitoring communication signals to the security guard operating the electronic computing device 22. The verbal statements of the first employee can be emitted through a speaker 24 of the electronic computing device 22, allowing the security guard to hear the first employee's statements.

The security guard can verbally respond to the first employee's statements. The statements of the security guard can be captured by a microphone 26 of the electronic computing device 22 and transmitted by the electronic computing device 22 as one or more directing communication signals to the monitoring server 12, as the security is directing the actions of the first employee. Directing communication signals provide guidance to the first employee in gathering evidence of theft. The monitoring server 12 can receive the directing communication signals from the security guard and transmit the directing communication signals to the first employee wearing the head mountable unit 14. The verbal statements of the security guard can be emitted through a speaker 52 of the head mountable unit 14, allowing the first employee to hear the security guard's statements.

The security guard can also receive video signals corresponding to the first employee's field of view, so that the security guard can see what the first employee is seeing. The field of view of the first employee can be captured by a camera 42 of the head mountable unit 14 and transmitted by the head mountable unit 14 as a monitoring communication signal to the monitoring server 12. The monitoring server 12 can receive a monitoring communication signal containing video data from the first employee and transmit the monitoring communication signal to the security guard operating the electronic computing device 22. The video feed corresponding to the first employee's field of view can be displayed on a display 28 of the electronic computing device 22, allowing the security guard to see what the first employee is seeing in real-time. The security guard can use the video feed to direct the first employee's gaze to a particular location to better gather evidence of theft. In some embodiments of the present disclosure, the video feed generated by the first employee can be "backdated" by some length of time, such as by way of example and not limitation one minute. This feature can be desirable since a theft may be witnessed before the first employee can speak or gesture to prompt the transmission of the theft alert signal. In some embodiments, the augmented reality device or the monitoring server can store a predetermined number of minutes of video.

The exchange of video and audio information can facilitate the first employee's usefulness in gathering evidence of theft within the retail store. In addition, the security guard can transmit textual data and information to the first employee with the electronic computing device 22. For example, the security guard can transmit textual directions to the first employee instead of verbal statements to prevent sound from being emitted by the speaker 52. The first employee can view the instructions on a display 46 of the head mountable unit 14.

Figure 2:
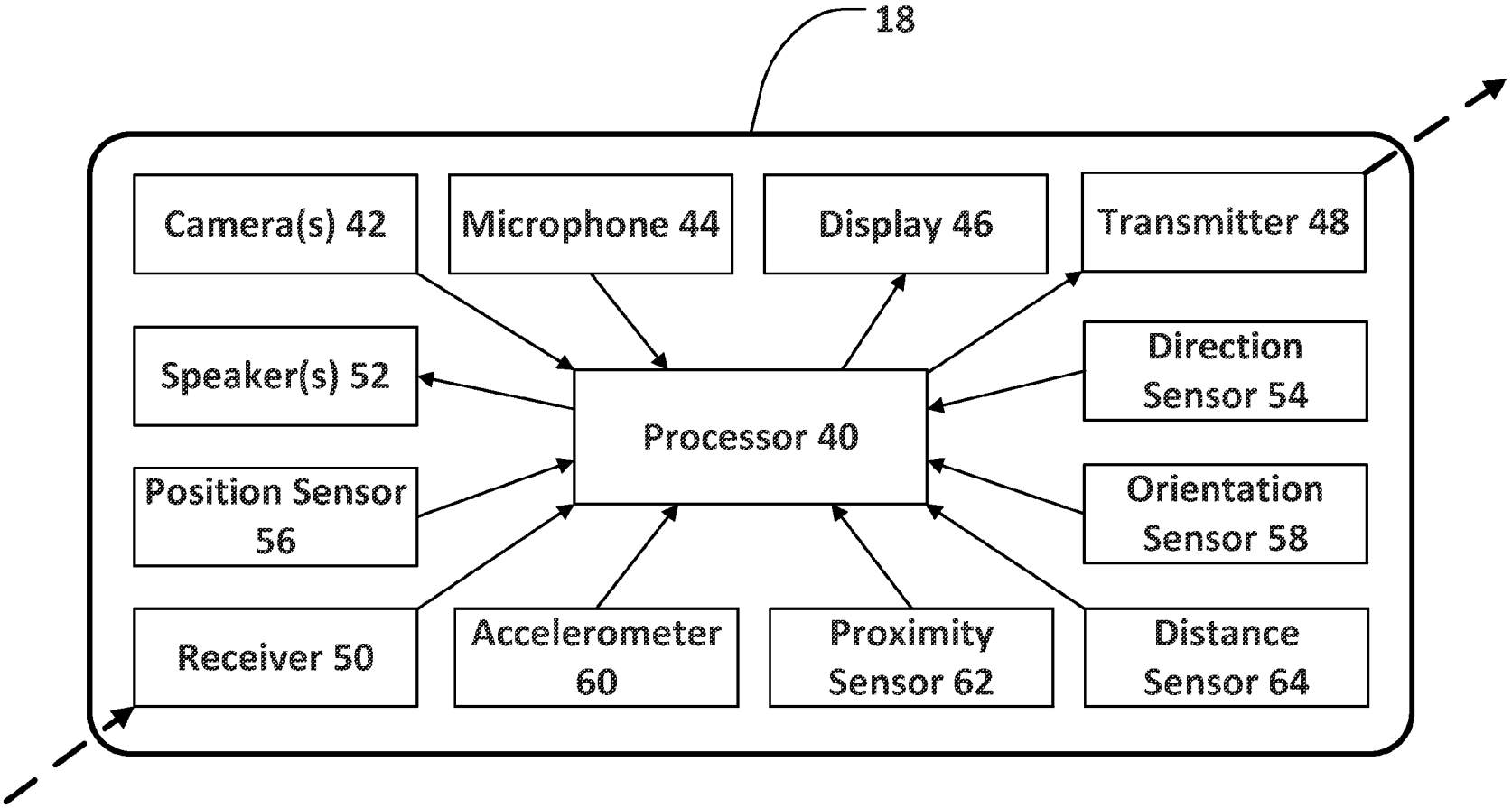
FIG. 2 is an example block diagram illustrating an augmented reality device that can be applied in some embodiments of the present disclosure.

FIG. 2 is a block diagram illustrating exemplary components of the communications unit 18 of the head mountable unit 14. The communications unit 18 can include a processor 40, one or more cameras 42, a microphone 44, a display 46, a transmitter 48, a receiver 50, one or more speakers 52, a direction sensor 54, a position sensor 56, an orientation sensor 58, an accelerometer 60, a proximity sensor 62, and a distance sensor 64.

The processor 40 can be operable to receive signals generated by the other components of the communications unit 18. The processor 40 can also be operable to control the other components of the communications unit 18. The processor 40 can also be operable to process signals received by the head mount unit 14. While one processor 40 is illustrated, it should be appreciated that the term "processor" can include two or more processors that operate in an individual or distributed manner.

The head mount unit 14 can include one or more cameras 42. Each camera 42 can be configured to generate a video signal. One of the cameras 42 can be oriented to generate a video signal that approximates the field of view of the first employee wearing the head mountable unit 14. Each camera 42 can be operable to capture single images and/or video and to generate a video signal based thereon. The video signal may be representative of the field of view of the first employee wearing the head mountable unit 14.

In some embodiments of the disclosure, cameras 42 may be a plurality of forward-facing cameras 42. The cameras 42 can be a stereo camera with two or more lenses with a separate image sensor or film frame for each lens. This arrangement allows the camera to simulate human binocular vision and thus capture three-dimensional images. This process is known as stereo photography. The cameras 42 can be configured to execute computer stereo vision in which three-dimensional information is extracted from digital images. In such embodiments, the orientation of the cameras 42 can be known and the respective video signals can be processed to triangulate an object with both video signals. This processing can be applied to determine the distance that the first employee is spaced from the object. Determining the distance that the first employee is spaced from the object can be executed by the processor 40 or by the monitoring server 12 using known distance calculation techniques.

Processing of the one or more, forward-facing video signals can also be applied to determine the identity of the object. Determining the identity of the object, such as the identity of an item in the retail store, can be executed by the processor 40 or by the monitoring server 12. If the processing is executed by the monitoring server 12, the processor 40 can modify the video signals limit the transmission of data back to the monitoring server 12. For example, the video signal can be parsed and one or more image files can be transmitted to the monitoring server 12 instead of a live video feed. Further, the video can be modified from color to black and white to further reduce transmission load and/or ease the burden of processing for either the processor 40 or the monitoring server 12. Also, the video can cropped to an area of interest to reduce the transmission of data to the monitoring server 12.

In some embodiments of the present disclosure, the cameras 42 can include one or more inwardly-facing camera 42 directed toward the first employee's eyes. A video signal revealing the first employee's eyes can be processed using eye tracking techniques to determine the direction that the first employee is viewing. In one example, a video signal from an inwardly-facing camera can be correlated with one or more forward-facing video signals to determine the object the first employee is viewing.

The microphone 44 can be configured to generate an audio signal that corresponds to sound generated by and/or proximate to the first employee. The audio signal can be processed by the processor 40 or by the monitoring server 12. For example, verbal signals can be processed by the monitoring server 12 such as "this item appears interesting." Such audio signals can be correlated to the video recording.

The display 46 can be positioned within the first employee's field of view. Video content can be shown to the first employee with the display 46. The display 52 can be configured to display text, graphics, images, illustrations and any other video signals to the first employee. The display 46 can be transparent when not in use and partially transparent when in use to minimize the obstruction of the first employee's field of view through the display 46.

The transmitter 48 can be configured to transmit signals generated by the other components of the communications unit 18 from the head mountable unit 14. The processor 40 can direct signals generated by components of the communications unit 18 to the commerce sever 12 through the transmitter 48. The transmitter 48 can be an electrical communication element within the processor 40. In one example, the processor 40 is operable to direct the video and audio signals to the transmitter 40 and the transmitter 48 is operable to transmit the video signal and/or audio signal from the head mountable unit 14, such as to the monitoring server 12 through the network 20.

The receiver 50 can be configured to receive signals and direct signals that are received to the processor 40 for further processing. The receiver 50 can be operable to receive transmissions from the network 20 and then communicate the transmissions to the processor 40. The receiver 50 can be an electrical communication element within the processor 40. In some embodiments of the present disclosure, the receiver 50 and the transmitter 48 can be an integral unit.

The transmitter 48 and receiver 50 can communicate over a Wi-Fi network, allowing the head mountable device 14 to exchange data wirelessly (using radio waves) over a computer network, including high-speed Internet connections. The transmitter 48 and receiver 50 can also apply Bluetooth® standards for exchanging data over short distances by using short-wavelength radio transmissions, and thus creating personal area network (PAN). The transmitter 48 and receiver 50 can also apply 3G or 4G, which is defined by the International Mobile Telecommunications-2000 (IMT-2000) specifications promulgated by the International Telecommunication Union.

The head mountable unit 14 can include one or more speakers 52. Each speaker 52 can be configured to emit sounds, messages, information, and any other audio signal to the first employee. The speaker 52 can be positioned within the first employee's range of hearing. Audio content transmitted by the monitoring server 12 can be played for the first employee through the speaker 52. The receiver 50 can receive the audio signal from the monitoring server 12 and direct the audio signal to the processor 40. The processor 40 can then control the speaker 52 to emit the audio content.

The direction sensor 54 can be configured to generate a direction signal that is indicative of the direction that the first employee is facing. The direction signal can be processed by the processor 40 or by the monitoring server 12. For example, the direction sensor 54 can electrically communicate the direction signal containing direction data to the processor 40 and the processor 40 can control the transmitter 48 to transmit the direction signal to the monitoring server 12 through the network 20. By way of example and not limitation, the direction signal can be useful in determining the identity of an item(s) visible in the video signal, as well as the location of the first employee within the retail store.

The direction sensor 54 can include a compass or another structure for deriving direction data. For example, the direction sensor 54 can include one or more Hall effect sensors. A Hall effect sensor is a transducer that varies its output voltage in response to a magnetic field. For example, the sensor operates as an analog transducer, directly returning a voltage. With a known magnetic field, its distance from the Hall plate can be determined. Using a group of sensors disposing about a periphery of a rotatable magnetic needle, the relative position of one end of the needle about the periphery can be deduced. It is noted that Hall effect sensors can be applied in other sensors of the head mountable unit 14.

The position sensor 56 can be configured to generate a position signal indicative of the position of the first employee within the retail store. The position sensor 56 can be configured to detect an absolute or relative position of the first employee wearing the head mountable unit 14. The position sensor 56 can electrically communicate a position signal containing position data to the processor 40 and the processor 40 can control the transmitter 48 to transmit the position signal to the monitoring server 12 through the network 20.

Identifying the position of the first employee can be accomplished by radio, ultrasound or ultrasonic, infrared, or any combination thereof. The position sensor 56 can be a component of a real-time locating system (RTLS), which is used to identify the location of objects and people in real time within a building such as a retail store. The position sensor 56 can include a tag that communicates with fixed reference points in the retail store. The fixed reference points can receive wireless signals from the position sensor 56. The position signal can be processed to assist in determining one or more items that are proximate to the first employee and are visible in the video signal. The monitoring server 12 can receive position data and identify the location of the first employee in some embodiments of the present disclosure.

The orientation sensor 58 can be configured to generate an orientation signal indicative of the orientation of the first employee's head, such as the extent to which the first employee is looking downward, upward, or parallel to the ground. A gyroscope can be a component of the orientation sensor 58. The orientation sensor 58 can generate the orientation signal in response to the orientation that is detected and communicate the orientation signal to the processor 40. The orientation of the first employee's head can indicate whether the first employee is viewing a lower shelf, an upper shelf, or a middle shelf.

The accelerometer 60 can be configured to generate an acceleration signal indicative of the motion of the first employee. The acceleration signal can be processed to assist in determining if the first employee has slowed or stopped, tending to indicate that the first employee is evaluating one or more items for purchase. The accelerometer 60 can be a sensor that is operable to detect the motion of the first employee wearing the head mountable unit 14. The accelerometer 60 can generate a signal based on the movement that is detected and communicate the signal to the processor 40. The motion that is detected can be the acceleration of the first employee and the processor 40 can derive the velocity of the first employee from the acceleration. Alternatively, the monitoring server 12 can process the acceleration signal to derive the velocity and acceleration of the first employee in the retail store.

The proximity sensor 62 can be operable to detect the presence of nearby objects without any physical contact. The proximity sensor 62 can apply an electromagnetic field or a beam of electromagnetic radiation such infrared and assess changes in the field or in the return signal. Alternatively, the proximity sensor 62 can apply capacitive photoelectric principles or induction. The proximity sensor 62 can generate a proximity signal and communicate the proximity signal to the processor 40. The proximity sensor 62 can be useful in determining when a first employee has grasped and is inspecting an item.

The distance sensor 64 can be operable to detect a distance between an object and the head mountable unit 14. The distance sensor 64 can generate a distance signal and communicate the signal to the processor 40. The distance sensor 64 can apply a laser to determine distance. The direction of the laser can be aligned with the direction that the first employee is facing. The distance signal can be useful in determining the distance to an object in the video signal generated by one of the cameras 42, which can be useful in determining the first employee's location in the retail store.

Figure 3:
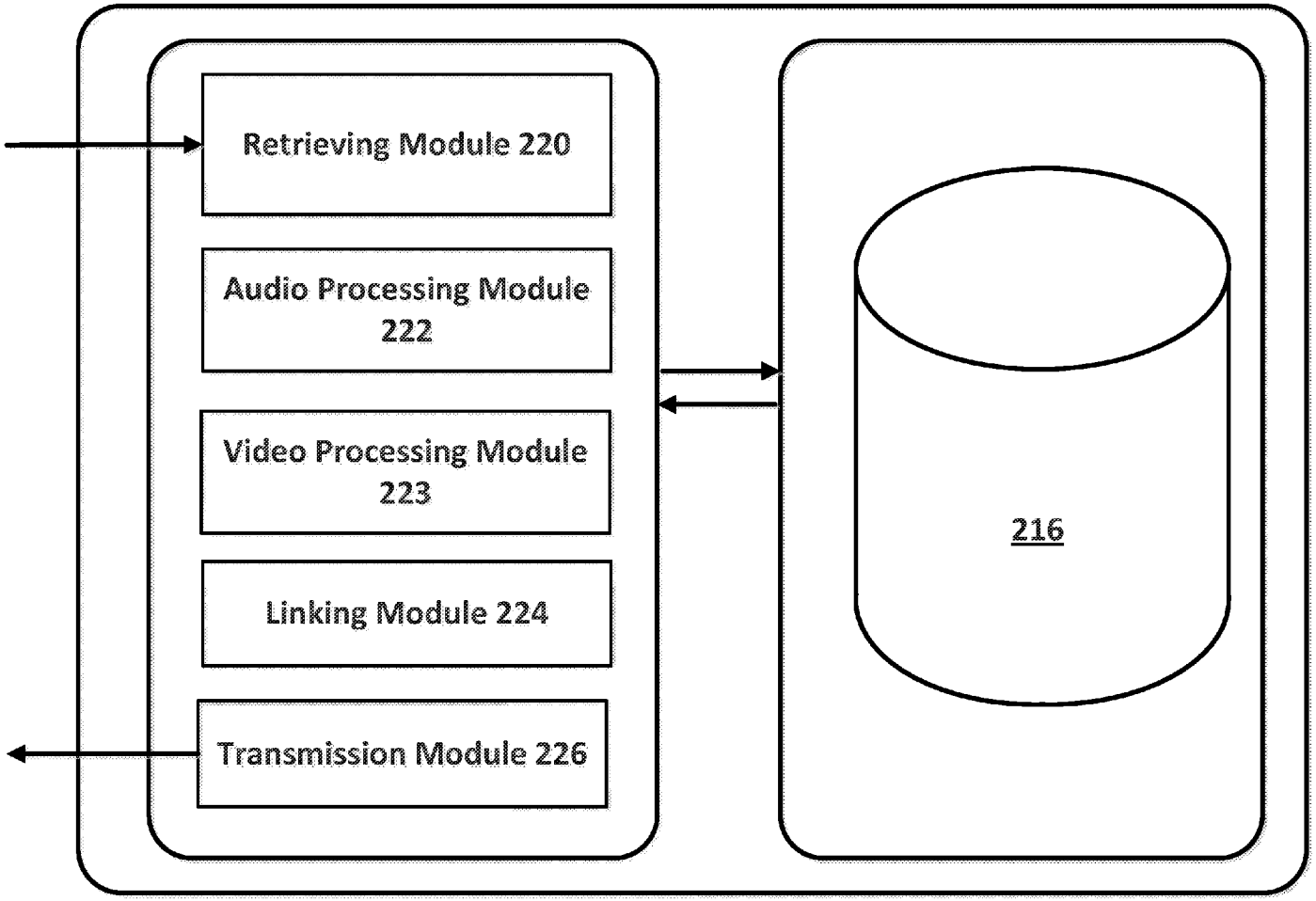
FIG. 3 is an example block diagram illustration of a monitoring server that can be applied in some embodiments of the present disclosure.

FIG. 3 is a block diagram illustrating a monitoring server 212 according to some embodiments of the present disclosure. In the illustrated embodiment, the monitoring server 212 can include a theft incident database 216. The monitoring server 212 can also include a processing device 218 configured to include a receiving module 220, an audio processing module 222, a video processing module 223, a linking module 224, and a transmission module 226.

Any combination of one or more computer-usable or computer-readable media may be utilized. For example, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

The theft incident database 216 can include memory containing data associated with interactions between first employees and security guards. The data associated with a particular interaction between a first employee and a security guard can include audio data, video data, textual data, or other forms of data. For example, verbal conversations between the first employee and security guard can be stored as data associated with a particular interaction in the theft incident database 216. A video signal that is generated by an augmented reality device worn by the first employee during the interaction can also be stored as data associated with a particular interaction in the theft incident database 216. The identity of the first employee who detected theft can also be stored as data associated with a particular interaction in the theft incident database 216. The identity of the security guard who assisted the first employee can also be stored as data associated with a particular interaction in the theft incident database 216. The data in the sale help interaction database 216 can be organized based on one or more tables that may utilize one or more algorithms and/or indexes.

The processing device 218 can communicate with the database 216 and can receive one or more signals from the head mountable unit 14 and from the electronic computing device 22. The processing device 218 can include computer readable memory storing computer readable instructions and one or more processors executing the computer readable instructions.

The receiving module 220 can be operable to receive signals over the network 20, assess the signals, and communicate the signals or the data contained in the signals to other components of the monitoring server 212. The receiving module 220 can be configured to receive theft alert signals and monitoring communication signals from one or more first employees wearing respective augmented reality devices. The receiving module 220 can also be configured to receive one or more directing communication signals from one or more security guards operating respective electronic computing devices.

The receiving module 220 can receive a signal containing audio data such as the voice of a first employee. A signal containing audio data can be directed to the audio processing module 222 for further processing. Speech by a first employee can be captured by the microphone 44 and transmitted to the monitoring server 212 by the head mountable unit 14. The voice of the first employee can be continuously monitored as the first employee shops in some embodiments of the present disclosure.

The audio processing module 222 can analyze the audio data contained in a first employee signal, such as verbal statements made by a first employee. The audio processing module 222 can implement known speech recognition techniques to identify speech in an audio signal. The first employee's speech can be encoded into a compact digital form that preserves its information. The encoding can occur at the head mountable unit 14 or at the monitoring server 212. The audio processing module 222 can be loaded with a series of models honed to comprehend language. When encoded locally, the speech can be evaluated locally, on the head mountable unit 14. A recognizer installed on the head mountable unit 14 can communicate with the monitoring server 212 to gauge whether the voice contains a command can be best handled locally or if the monitoring server is better suited to execute the command. The audio processing module 222 can compare the first employee's speech against a statistical model to estimate, based on the sounds spoken and the order in which the sounds were spoken, what letters might be contained in the speech. At the same time, the local recognizer can compare the speech to an abridged version of that statistical model applied by the audio processing module 222. For both the monitoring server 212 and the head mountable unit 14, the highest-probability estimates are accepted as the letters contained in the first employee's speech. Based on these estimations, the first employee's speech, now embodied as a series of vowels and consonants, is then run through a language model, which estimates the words of the speech. Given a sufficient level of confidence, the audio processing module 222 can then create a candidate list of interpretations for what the sequence of words in your speech might mean. If there is enough confidence in this result, the audio processing module 222 can determine the first employee's intent.

In a first example, a first employee can state "I see a theft in progress" in an embodiment of the present disclosure. This statement can be contained in a signal received by the monitoring server 212. The signal can be processed and the statement can be recognized by the audio processing module 222. In response, the audio processing module 222 can communicate the indication that a theft is occurring to the linking module 224 for further processing, as will be set forth in greater detail below. Thus, the signal containing the first employee's voice expressing a theft is occurring can define a theft alert signal.

The receiving module 220 can receive a signal containing video data such as video containing the field of view of the first employee. A signal containing video data can be directed to the video processing module 223 for further processing. The field of view of the first employee can be captured by the camera 52 and transmitted to the monitoring server 212 by the head mountable unit 14. The video showing the field of view of the first employee can be continuously monitored as the first employee works within the retail store in some embodiments of the present disclosure.

The video processing sub-module 223 can receive a video signal generated by the camera 42 of the head mountable unit 14 from the receiving module 222. The display 46 of the head mountable unit 14 can overlap the field of view of the camera 42. Thus, the view of the first employee can also define the field of view of a video signal generated by the camera 42 and communicated to the monitoring server 212.

The video processing sub-module 223 can implement known video recognition/analysis techniques and algorithms to identify hand gestures by the first employee in the field of view of the camera 42. For example, the video processing sub-module 223 can identify the first employee's hand moving, such as movement in one rectilinear direction, rotation motion, and side-to-side or up-down movement. Any form of movement can be recognized as a theft alert signal by the commerce server in various embodiments of the present disclosure. The video signal can be processed and the images showing movement of the first employee's hand can be recognized by the video processing module 223. In response, the video processing module 223 can communicate the indication that a theft is occurring to the linking module 224 for further processing, as will be set forth in greater detail below. Thus, the signal containing the first employee's hand gesturing in the field of view can define a theft alert signal.

The linking module 224 can be configured to act on theft alerts contained in signals received from first employees. In response to the detection of a theft alert by the audio processing module 222 or video processing module 223, the linking module 224 can direct the transmission module 226 to transmit a signal to the electronic computing device 22. The initial signal transmitted to the electronic computing device 22 can include the data in the theft alert signal itself, such the voice of the first employee. In some embodiments of the present disclosure, the initial signal transmitted to the electronic computing device 22 can also contain the identity of the first employee (based on the identity of the head mountable unit 14), the location of the retail store occupied first employee, and/or some other data that may be useful in assisting the security guard. Subsequent monitoring communication signals can also be directed to the electronic computing device 22, unaltered or supplemented.

The electronic computing device 22 can respond to the initial theft alert signal received from the monitoring server 212 and subsequent monitoring communication signals by transmitting one or more directing communication signals back to the monitoring server. The receiving module 220 can be configured to pass directing communication signals to the linking module 224, bypassing the audio processing module 222 and the video processing module 223. The linking module 224 can direct the transmission module 226 to transmit directing communication signals to the head mountable unit 14. Thus, the linking module 224 can facilitate continuous and real-time communication between the first employee and the security guard.

After receiving an initial theft alert signal from the first employee, the linking module 224 can direct the receiving module 222 to direct audio and video signals received from the head mountable unit 14 directly to the linking module 224 and bypass the audio processing module 222 and the video processing module 223. The linking module 224 can then direct the transmission module 226 to transmit these signals, monitoring communication signals, to the electronic computing device 22.

The linking module 224 can also be configured to direct data associated with the interaction between the first employee and the security guard to the theft incident database 216 for storage. In response to the detection of a theft alert by the audio processing module 222, the linking module 224 can access the theft incident database 216 and establish an entry for the current interaction. Subsequent signals that are received from either the first employee or the security guard can be transmitted to the other party and also stored in the theft incident database 216. Thus, the theft incident database 216 can contain a record of each first employee-security guard interaction. Each record or entry in the theft incident database 216 can include data identifying the first employee, the security guard, the date and time of the interaction, and/or the location of the retail store occupied by the first employee in some embodiments of the present disclosure.

After a theft detection interaction has ended, the security guard can control the electronic computing device 22 to transmit a termination signal to the monitoring server 212. The termination signal can contain data directing the linking module 224 to terminate the link. The linking module 224 can direct the receiving module 220 to again direct audio signals from the head mountable unit 14 to the audio processing module 222 and direct video signals from the head mountable unit 14 to the video processing module 223.

It is noted that the various processing functions set forth above can be executed differently than described above in order to enhance the efficiency of an embodiment of the present disclosure in a particular operating environment. The processor 40 can assume a greater role in processing some of the signals in some embodiments of the present disclosure.

For example, in some embodiments, the processor 40 of the head mountable unit 14*a* could modify the video signal to require less bandwidth. The processor 40 could convert a video signal containing color to black and white in order to reduce the bandwidth required for transmitting the video signal. In some embodiments, the processor 40 could crop the video, or sample the video and display frames of interest. A frame of interest could be a frame that is significantly different from other frames, such as a generally low quality video having an occasional high quality frame. Thus, in some embodiments, the processor 40 could selectively extract video or data of interest from a video signal containing data of interest and other data.

Figure 4A:
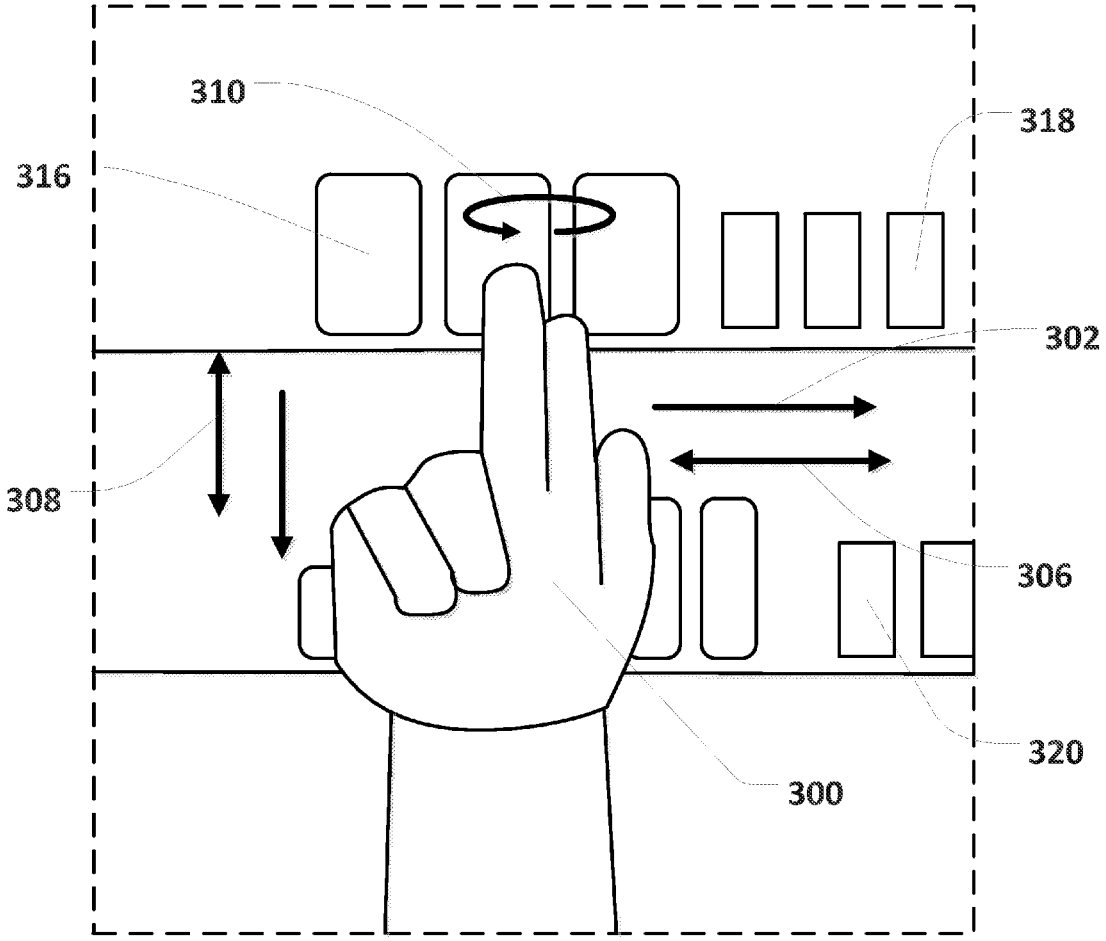
FIG. 4A is an example screen shot of a video signal generated by a head mountable unit during a theft incident in some embodiments of the present disclosure.

FIG. 4A is an image of a video signal captured by a head mountable unit in some embodiments of the disclosure. In FIG. 4A, a first employee's hand 300 is visible in the video signal. The first employee's hand 300 can follow rectilinear movement, such as movement to the right as referenced at 302 or movement down as referenced at 304. A video processing module 223 according to some embodiments of the present disclosure can also detect side-to-side movement such as referenced at 306 and up and down movement referenced at 308. A video processing module 223 according to some embodiments of the present disclosure can also detect rotational movement of the hand 300 such as referenced at 310. Behind the hand 300, store shelves 312, 314 are visible supporting items 316, 318, 320. Any of these forms of gesturing by the hand can be recognized by the monitoring server 212 as a theft alert signal.

Figure 4B:
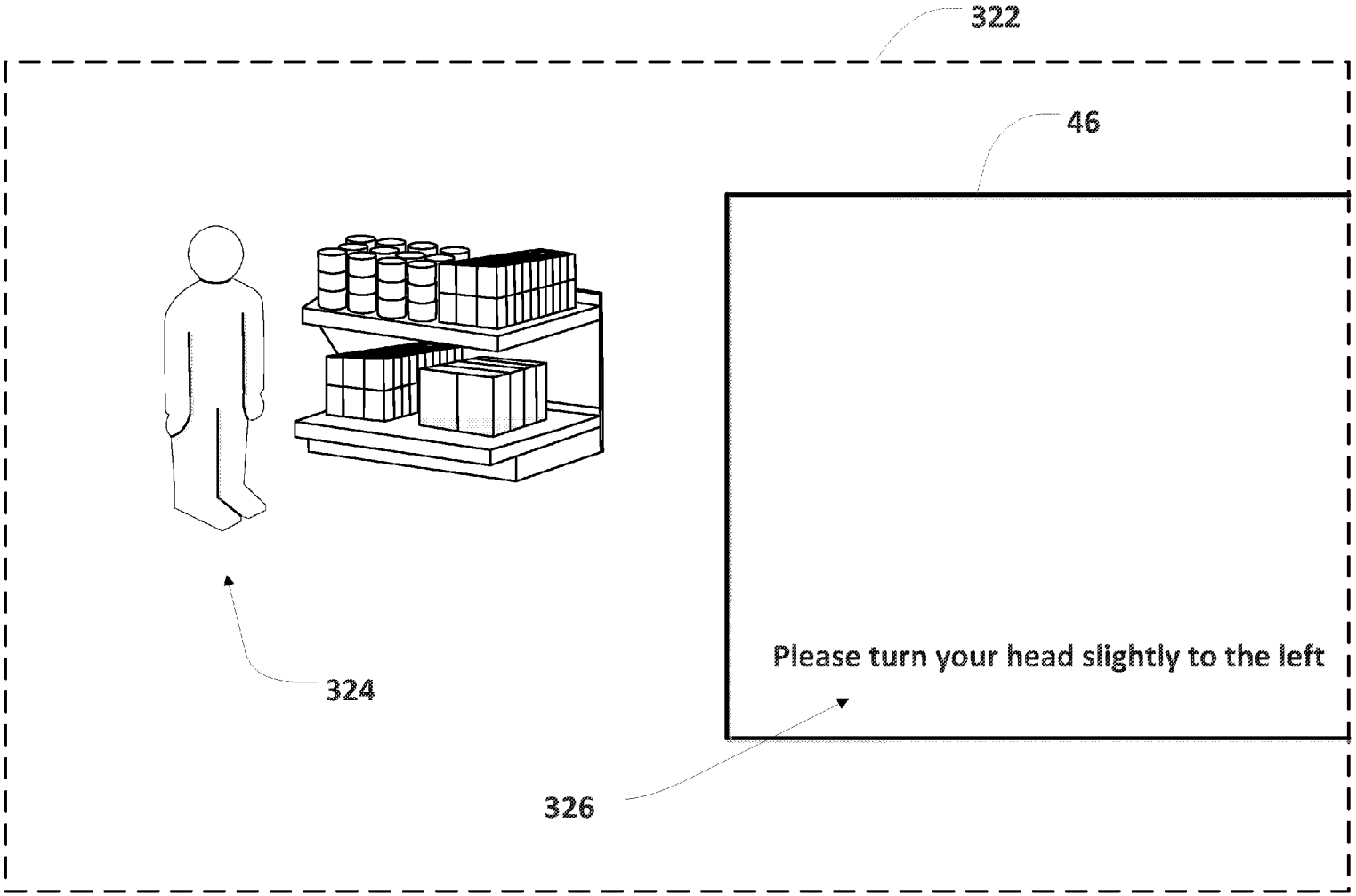
FIG. 4B is an exemplary field of view of a first employee in some embodiments of the present disclosure.

FIG. 4B is a second exemplary field of view of a first employee while working in some embodiments of the present disclosure. The first employee's field of view is bounded in this example by the box referenced at 322. The first employee has observed a person 324 acting suspiciously and has transmitted a theft alert signal with the head mountable unit 14, such as with a verbal statement or by gesturing.

Figure 4C:
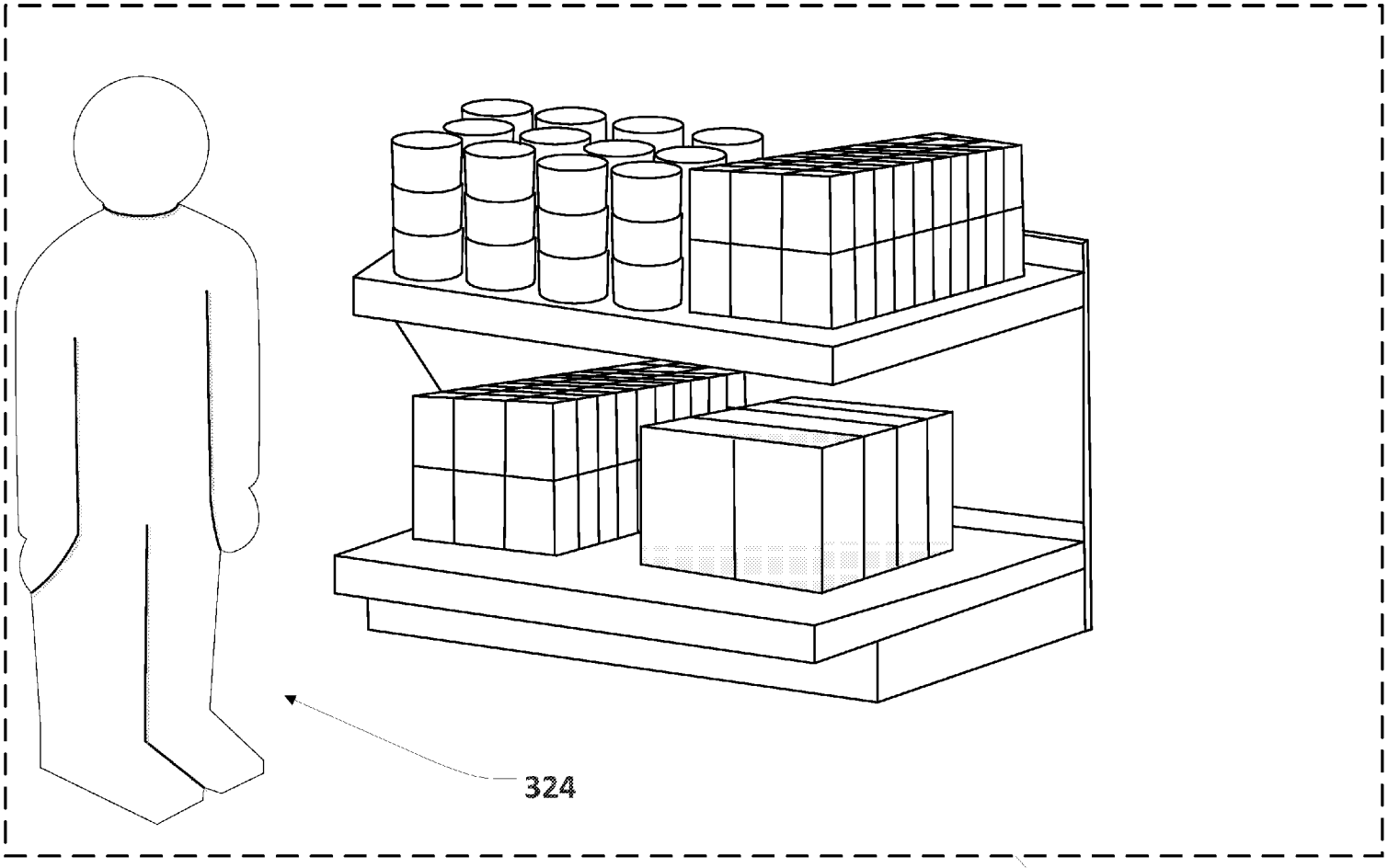
FIG. 4C is an example view of a display visible with the augmented reality device by a security guard in some embodiments of the present disclosure.

A portion of the first employee's field of view is overlapped by the display 46 of the head mountable unit 14. In FIG. 4B, the display 46 is engaged. Direction from the security guard is being displayed by the display 46 and referenced at 326. In the exemplary embodiment, the data displayed by the display 46 is textual data providing direction to the first employee from the security guard. FIG. 4C shows the view on the display 28 of the electronic computing device 22 as the first employee is viewing the field 322 in FIG. 4B. The security guard can direct the first employee to shift his view so that the person 324, the suspected thief, is more centered in the display 28. The video displayed by the display 28 can be recorded in the theft incident database 216.

Figure 5:
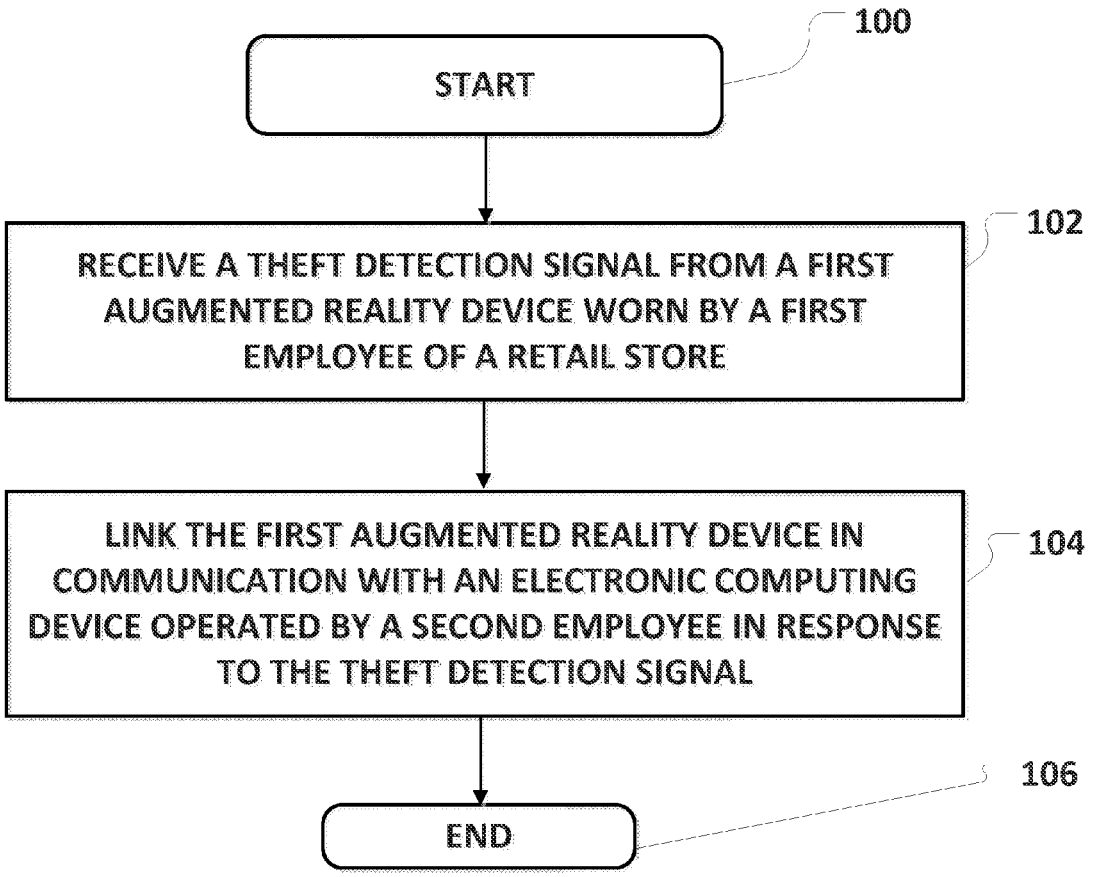
FIG. 5 is an example flow chart illustrating a method theft in accordance with some embodiments of the present disclosure.

FIG. 5 is a flowchart illustrating a method that can be carried out in some embodiments of the present disclosure. The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function (s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

FIG. 5 illustrates a method that can be executed by a monitoring server. The method starts at step 100. At step 102, the monitoring server can receive a theft detection signal from a first augmented reality device worn by a first employee of a retail store. At step 104, the monitoring server can link the first augmented reality device in communication with an electronic computing device operated by a second employee in response to the theft detection signal. As a result, the second employee can assist the first employee in assessing whether a theft is occurring. The exemplary method ends at step 106.

It is noted that the terms "employee" and security guard have been used to distinguish two parties from one another for clarity. Embodiments of the present disclosure can be practiced in which neither the "first employee" or the security guard are employees of the retail store in legal sense, both are employees of the retail store, or one of the "first employee" or the security guard are employees of the retail store. The parties interacting to capture theft can be third party contractors are have some other relationship with respect to the retail store.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS")), and deployment models (e.g., private cloud, community cloud, public cloud, hybrid cloud, etc.).

The above description of illustrated examples of the present disclosure, including what is described in the Abstract, are not intended to be exhaustive or to be limitation to the precise forms disclosed. While specific embodiments of, and examples for, the present disclosure are described herein for illustrative purposes, various equivalent modifications are possible without departing from the broader spirit and scope of the present disclosure. Indeed, it is appreciated that the specific example voltages, currents, frequencies, power range values, times, etc., are provided for explanation purposes and that other values may also be employed in other embodiments and examples in accordance with the teachings of the present disclosure.

What is claimed is:

1. A computer-implemented method comprising:

providing a body mounted first augmented reality electronic device capable of transmitting a media signal consisting of at least one of an audio and a video signal to a first employee of a retail store whereby the augmented reality device is worn on the first employee in the retail store;

receiving, at a processing device of a store monitoring server, a media signal from the first augmented reality device when the first augmented reality device is worn on the body of the first employee of a retail store;

the processing device of the store monitoring server identifying a theft detection signal communicated by the first employee in the media signal; and linking, with the store monitoring server processing device, the first augmented reality device to an electronic computing device operated by a second store employee to facilitate communication between the augmented reality device and the electronic computing device in response to said step of identifying the theft detection signal, such that the second employee can assist the first employee in assessing whether a theft is occurring.

2. The computer-implemented method of claim 1 wherein said identifying step comprises:

the processing device analyzing an audio signal from the augmented reality device and identifying a theft detection signal in the audio signal by identifying sound which is likely to represent an audible theft detection signal from the first employee.

3. The computer-implemented method of claim 2 wherein said identifying step comprises:

the processing device identifying a theft detection signal from a voice of the first employee.

4. The computer-implemented method of claim 1 wherein said identifying step comprises:

the processing device analyzing an audio signal from the augmented reality device to identify words spoken by the first employee from the audio signal, and identifying words spoken by the first employee which are likely to be a theft detection signal spoken by the first employee.

5. The computer-implemented method of claim 1 wherein said identifying step comprises:

the processing device analyzing a video signal from the augmented reality device and identifying a theft detection signal in the video signal by identifying motion in images in the video signal which is likely to represent a visual theft detection signal from the first employee.

6. The computer-implemented method of claim 5 wherein said identifying step comprises:

the processing device identifying, in images in the video signal, hand gestures made by the first employee which are likely to be a theft detection signal made by the first employee.

7. The computer-implemented method of claim 5 wherein said identifying step comprises:

the processing device identifying motion which is indicative of a theft in images of the video signal.

8. The computer-implemented method of claim 1 wherein said linking step further comprises:

receiving, with the processing device, a monitoring communication signal distinct from the theft detection signal from the first augmented reality device containing audio data; and transmitting, with the processing device, the monitoring communication signal to the electronic computing device.

9. The computer-implemented method of claim 8 wherein said step of receiving the monitoring communication signal further comprises:

receiving, with the processing device, the monitoring communication signal from the first augmented reality device, wherein the monitoring communication signal contains a voice of the first employee.

10. The computer-implemented method of claim 9 further comprising the step of:

storing the data contained in the monitoring communication signal in a theft incident database.

11. The computer-implemented method of claim 1 wherein said linking step further comprises:

receiving, with the processing device, a monitoring communication signal distinct from the theft detection signal from the first augmented reality device containing video data; and transmitting, with the processing device, the monitoring communication signal to the electronic computing device.

12. The computer-implemented method of claim 11 wherein said step of receiving the monitoring communication signal further comprises:

receiving, with the processing device, the monitoring communication signal from the first augmented reality device, wherein the monitoring communication signal contains at least part of a field of view the first employee.

13. The computer-implemented method of claim 12 further comprising the step of:

storing the data contained in the monitoring communication signal in a theft incident database.

14. The computer-implemented method of claim 1 further comprising:

receiving, with the processing device of the store monitoring server, a directing communication signal from the electronic computing device operated by a second store employee, the directing communication signal indicating a change in the media signal transmitted by the augmented reality device; and transmitting, with the processing device, the directing communication signal to the first augmented reality device.

15. The computer-implemented method of claim 14 wherein said directing communication signal comprises an audible speech signal.

16. The computer-implemented method of claim 15 further comprising the step of:

storing the data contained in the directing communication signal in a theft incident database.

17. The computer-implemented method of claim 14, wherein the directing communication signal comprises a visual signal, and wherein the method further comprises the augmented reality device visually displaying the directing communication signal to the first employee.

18. The computer-implemented method of claim 17 further comprising the step of:

storing the data contained in the directing communication signal in a theft incident database.

19. The computer-implemented method of claim 1 wherein said linking step is further defined as:

facilitating, with the processing device, real-time communication between the first augmented reality device worn by the first employee and the electronic computing device operated by the second employee as a theft incident is occurring.

20. The computer-implemented method of claim 19 further comprising:

storing substantially all of the real-time communication between the first augmented reality device worn by the first employee and the electronic computing device operated by the second employee as a theft incident is occurring in a theft incident database.

* * * * *